US011814833B2

(12) United States Patent
Reinhart

(10) Patent No.: US 11,814,833 B2
(45) Date of Patent: Nov. 14, 2023

(54) UTILITY SINK SYSTEM AND METHOD OF ASSEMBLY

(71) Applicant: NICKOLAS BRANDS, LLC, Findlay, OH (US)

(72) Inventor: Nickolas Reinhart, Sarasota, FL (US)

(73) Assignee: NICKOLAS BRANDS, LLC, Findlay, OH (US)

( * ) Notice: Subject to any disclaimer, the term of this patent is extended or adjusted under 35 U.S.C. 154(b) by 0 days.

(21) Appl. No.: 17/752,964

(22) Filed: May 25, 2022

(65) Prior Publication Data

US 2022/0381018 A1 Dec. 1, 2022

Related U.S. Application Data

(60) Provisional application No. 63/193,130, filed on May 26, 2021.

(51) Int. Cl.

| | |
|---|---|
| ***E03C 1/326*** | (2006.01) |
| ***E03C 1/182*** | (2006.01) |
| ***E03C 1/328*** | (2006.01) |

(52) U.S. Cl.

CPC ..... *E03C 1/326* (2013.01); *E03C 1/182* (2013.01); *E03C 1/328* (2013.01)

(58) Field of Classification Search

CPC . E03C 1/182; E03C 1/326; E03C 1/28; E03C 1/14; E03C 1/16; E03C 1/18; E03C 1/186; A47K 1/02; A47K 1/04; A47K 1/05; A47B 13/003; A47B 13/021; A47B 47/0008; A47B 91/005; A47B 91/12; A47B 91/024; A47B 2200/0025

See application file for complete search history.

(56) References Cited

U.S. PATENT DOCUMENTS

| | | | | |
|---|---|---|---|---|
| 3,384,230 A * | 5/1968 | Mustee | D06F 1/00 206/320 |
| 3,730,109 A * | 5/1973 | Kreizel | A47B 3/12 297/440.22 |
| 4,746,088 A * | 5/1988 | Kruger | A47B 91/00 248/188.8 |
| 7,854,030 B2 * | 12/2010 | Lee | A47K 1/00 211/41.9 |
| D652,901 S | 1/2012 | Didehvar et al. | |

(Continued)

FOREIGN PATENT DOCUMENTS

CN 110507232 A * 11/2019 ..... A47K 1/02

*Primary Examiner* — Erin Deery

(74) *Attorney, Agent, or Firm* — Jacob M. Ward; Ward Law Office LLC

(57) ABSTRACT

A utility sink system can include a basin having a base wall and a sidewall extending substantially perpendicularly therefrom. A leg can be permanently coupled to the basin. A shelf can be permanently coupled to the leg. The shelf can encapsulate the leg. A kit for a utility sink system can include a basin having a base wall and a sidewall extending substantially perpendicularly therefrom. A leg can be configured to be permanently coupled to the basin. A shelf can be configured to be permanently coupled to the leg. The shelf can be configured to encapsulate the leg. A method for assembling a utility sink system can include providing the kit. The method can further include coupling the leg to the basin and coupling the shelf to the leg.

17 Claims, 8 Drawing Sheets

(56) References Cited

U.S. PATENT DOCUMENTS

| | | | | |
|---|---|---|---|---|
| 8,117,689 | B2 * | 2/2012 | Slayton | E03C 1/18 4/619 |
| 9,066,631 | B2 | 6/2015 | Didehvar et al. | |
| 9,790,674 | B1 * | 10/2017 | Reese | E03C 1/326 |
| 2005/0044626 | A1 * | 3/2005 | Rocci | A47J 47/20 4/656 |
| 2021/0071700 | A1 * | 3/2021 | Zanette | F16B 7/02 |
| 2021/0230851 | A1 * | 7/2021 | Grybush | E03C 1/33 |

* cited by examiner

UTILITY SINK SYSTEM AND METHOD OF ASSEMBLY

CROSS-REFERENCE TO RELATED APPLICATIONS

This application claims the benefit of U.S. Provisional Application Ser. No. 63/193,130, filed on May 26, 2021. The entire disclosure of the above application is incorporated herein by reference.

FIELD

The disclosure generally relates to sinks and, more particularly, to utility sink systems.

INTRODUCTION

This section provides background information related to the present disclosure which is not necessarily prior art.

Conventional utility sinks provide a basin that is sized and shaped to receive and temporarily store water flowing from a faucet and/or household or commercial items, such as wash buckets or paint cans, therein. Conventional utility sinks are useful for washing or temporarily storing items but lack additional features that would improve the versatility and usability of the utility sink.

It would be desirable to create a utility sink that improves upon the characteristics of conventional utility sinks. For example, it would be desirable to create a utility sink that provides additional storage for a variety of household or commercial items. More specifically, it would be desirable to create a utility sink having a shelf beneath the basin and a removable tray that may be used in conjunction with a hose of a faucet for supporting various items in or above the basin.

It would also be desirable to provide a utility sink that is easier to transport to a user. An easily transportable utility sink may include separated legs which may minimize the size of the container required to transport the sink basin portion and the separated legs. However, utility sinks that have easily removable legs often have compromised structural integrity. As can be seen, there is a need for an improved utility sink system that provides additional storage options, can be easily transported to a user, and is structurally enhanced.

SUMMARY

In concordance with the instant disclosure, a utility sink system and method that provides additional storage options, can be easily transported to a user, and is structurally enhanced, has been surprisingly discovered.

In one embodiment, a utility sink system can include a basin having a base wall and a sidewall extending substantially perpendicularly therefrom. A leg can be permanently coupled to the basin. A shelf can be permanently coupled to the leg. The shelf can encapsulate a portion of the leg.

In another embodiment, a kit for a utility sink system can include a basin having a base wall and a sidewall extending substantially perpendicularly therefrom. A leg can be configured to be permanently coupled to the basin. A shelf can be configured to be permanently coupled to the leg. The shelf can be configured to encapsulate a portion of the leg.

In a further embodiment, a method for assembling a utility sink system can include providing a basin having a base wall and a sidewall extending substantially perpendicularly therefrom, a leg configured to be permanently coupled to the basin, a shelf configured to be permanently coupled to the leg. The method can further include performing one of coupling the leg to the basin and coupling the shelf to the leg.

In certain embodiments, a utility sink system is provided that includes a basin, a leg, and a shelf. The basin may include a base wall and a sidewall extending substantially perpendicularly therefrom. The leg may be permanently coupled to the basin. The shelf may be permanently coupled to the leg. The shelf may include a first surface and a second surface. In certain embodiments the leg may include an upper leg and a lower leg. The upper leg may be disposed between the basin and the first surface of the shelf. The lower leg may extend outwardly from the second surface of the shelf. In certain embodiments, the upper leg may be integrally formed with the basin; e.g., the upper leg and basin may be part of a unitary structure formed by injection molding. The utility sink system may further include a tray configured to be disposed on or within the basin.

In certain embodiments, the shelf may encapsulate a portion of the leg. In a specific example, the shelf may accept each of a terminal end of the upper leg and a terminal end of the lower leg. Advantageously, by encapsulating a portion of the leg with the shelf or accepting a portion of the leg into the shelf, the structural integrity and the strength of the utility sink system may be enhanced.

In certain embodiments, a ledge may be disposed on the interior of the sidewall of the basin. In a specific example, the tray may further include an array of slats. The tray may be configured to support an item disposed on the tray while permitting a liquid to pass through the array of slats. The tray may include a handle. The handle may be an opening disposed through the tray. The handle may be an elongated opening configured to permit a user to grasp the tray through the opening. The handle may further include a cylindrically shaped opening configured to permit a hose or a faucet head to be disposed therethrough. The tray may include a plurality of support structures. In certain embodiments, the support structures may be disposed in an X-formation, a V-formation, or both. Advantageously, the orientation of the support structures may enhance the structural integrity of the tray. One skilled in the art may select any orientation of the support structures, within the scope of the present disclosure.

In certain embodiments, the base wall of the basin may have a plurality of braces. In certain embodiments, the braces may be disposed in an X-formation, a V-formation, or both. Advantageously, the orientation of the braces may enhance the structural integrity of the basin. One skilled in the art may select any orientation of the braces, within the scope of the present disclosure.

In certain embodiments, the utility sink system may include a foot removably coupled to the leg. In a specific example, each of the foot and the lower leg may include complementary threaded portions configured to removably couple the foot to the lower leg. The complementary threaded portions may also provide a way to adjust the positioning of the utility sink system, when necessary, for instance, where the utility sink system is placed on an uneven or unlevel surface. The foot may include one or more ridges extending along a vertical length of the foot. The ridges may militate against the foot from slipping within a hand of a user, where the user is coupling the foot to the lower leg. The ridges may further reinforce the foot with respect to the weight of a remainder of the utility sink system, including any contents or liquids therein. The foot may further include a means of anchoring the utility sink system to a surface. In a specific example, the means of anchoring the utility sink system may include an aperture in the foot. The aperture in the foot may be configured to permit a user to bolt, stake, or otherwise couple the utility sink system to the surface.

In certain embodiments, the utility sink system may include a rack. The rack may be permanently disposed to the basin. The rack may include a drying means. In a specific example, the drying means may include one or more recessed surfaces and one or more fins extending from the one or more recessed surfaces. The recessed surface may be oriented substantially transverse to the sidewall of the basin. The fin may be configured to support an object (not shown), allowing any liquid (not shown) to drain onto the recessed surface. The recessed surface may be further disposed at an angle configured to direct the liquid (not shown) into the basin. The rack may further include one or more openings. Such openings may be configured to accept a faucet assembly and/or a hose therethrough.

In certain embodiments, the utility sink system may include a removable dish. The removable dish may include a center wall. The dish may further include an L-shaped flange which may be configured to be disposed over a sidewall of the basin. Advantageously, the L-shaped flange may permit the removable dish to be quickly disposed on and removed from the basin. One skilled in the art may select other suitable designs for the removable dish, within the scope of the present disclosure.

The rack may further include a rear wall that may be oriented substantially transverse to the rack. In certain embodiments, the rear wall may be oriented at an angle of 90 degrees from the rack. The rear wall may extend upwardly from the rack. Advantageously, the upwardly extending rear wall may be configured to provide a splash rack feature. In certain embodiments, the rear wall may extend downwardly from the rack. Desirably, the downwardly extending rear wall may permit the utility sink system to be coupled to a wall.

In certain embodiments, the utility sink system may include a kit. The kit may include a basin, a leg configured to be permanently coupled to the basin, and a shelf configured to be permanently coupled to the leg. In certain embodiments the leg may include an upper leg and a lower leg. In a specific example, the basin may include a basin detent. The basin detent may be configured to be inserted into an aperture in the upper leg. Where the basin detent is inserted into the aperture in the upper leg, the basin may be permanently coupled to the upper leg. In certain embodiments, the upper leg may include a leg detent configured to be inserted into a hole disposed in the shelf. Where the leg detent is inserted into the hole in the shelf, the upper leg may be permanently coupled to the shelf. In a specific example, the shelf may further include a shelf detent and the lower leg may further include a lower leg aperture. Where the shelf detent is inserted into the lower leg aperture, the lower leg may be permanently disposed to the shelf. Advantageously, the kit may permit the utility sink system to be packaged in a smaller volume of space, thereby enhancing the shipment and transportation of the system.

Various ways of assembling the utility sink system are provided. Certain methods may include a step of providing the basin, the leg configured to be permanently coupled to the basin, and the shelf configured to be permanently coupled to the leg. Next, the method may include a step of performing one of coupling the basin to the leg and coupling the leg to the shelf. The step of coupling the basin to the leg may further include inserting the basin detent into the aperture in the leg. The step of coupling the leg to the shelf may further include inserting the leg detent into the hole disposed in the shelf. The foot may be coupled to the leg in another step. The tray may be inserted into the basin in another step.

Advantageously, the utility sink system provides additional storage options, can be easily transported to a user, and is structurally enhanced.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
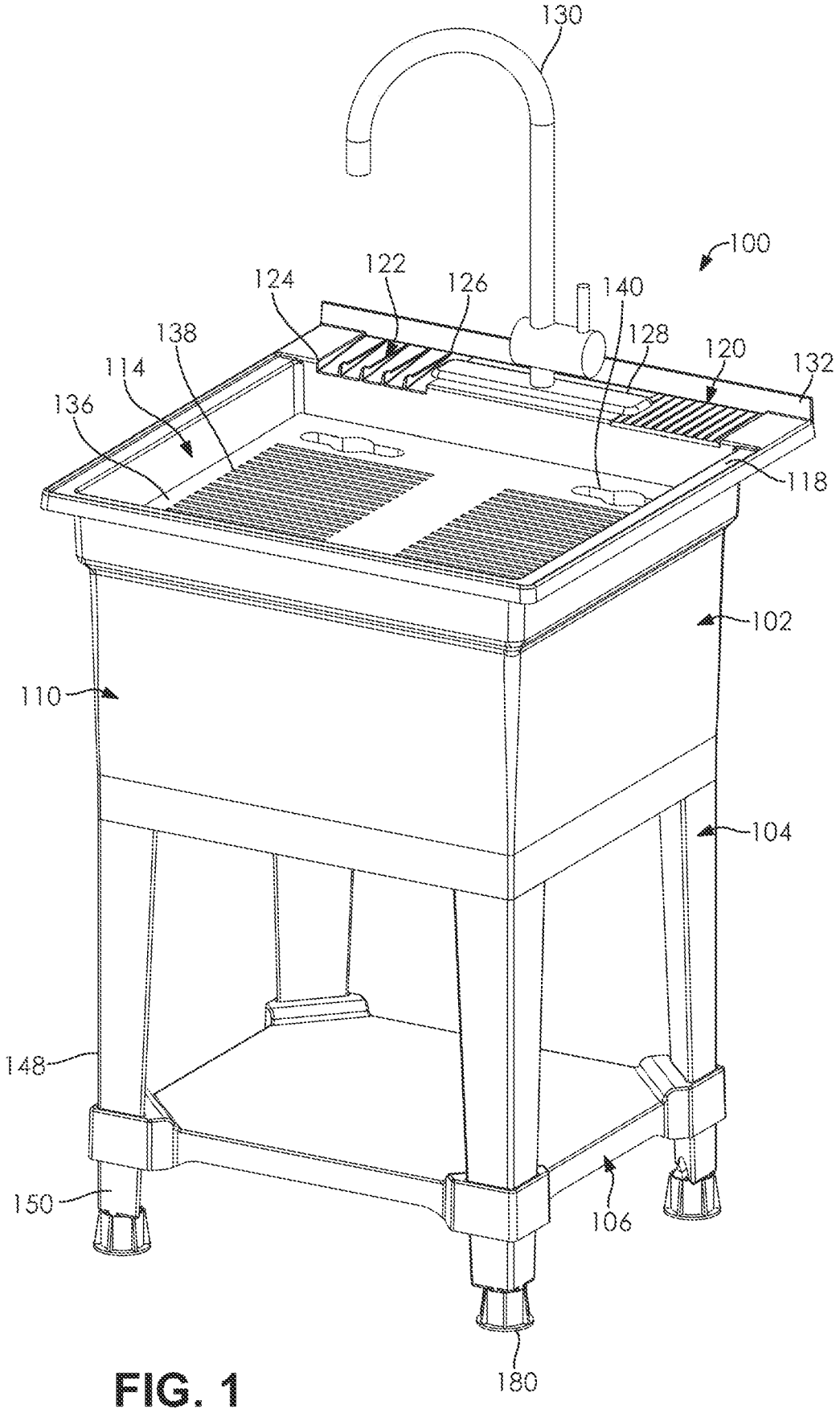
FIG. 1 is a front perspective view of an embodiment of a utility sink system, in accordance with the present disclosure.

The following description of technology is merely exemplary in nature of the subject matter, manufacture, and use of one or more inventions, and is not intended to limit the scope, application, or uses of any specific invention claimed in this application or in such other applications as can be filed claiming priority to this application, or patents issuing therefrom. Regarding methods disclosed, the order of the steps presented is exemplary in nature, and thus, the order of the steps can be different in various embodiments, including where certain steps can be simultaneously performed.

The terms "a" and "an" as used herein indicate "at least one" of the item is present; a plurality of such items can be present, when possible. Except where otherwise expressly indicated, all numerical quantities in this description are to be understood as modified by the word "about" and all geometric and spatial descriptors are to be understood as modified by the word "substantially" in describing the broadest scope of the technology. The term "about" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that can arise from ordinary methods of measuring or using such parameters.

Although the open-ended term "comprising," as a synonym of non-restrictive terms such as including, containing, or having, is used herein to describe and claim embodiments of the present technology, embodiments can alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application.

Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter can define endpoints for a range of values that can be claimed for the parameter. For example, if Parameter X is exemplified herein to have value A and also exemplified to have value Z, it is envisioned that Parameter X can have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X can have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it can be directly on, engaged, connected, or coupled to the other element or layer, or intervening elements or layers can be present. In contrast, when an element is referred to as being "directly on," "directly engaged to," "directly connected to" or "directly coupled to" another element or layer, there can be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. can be used herein to describe various elements, components, regions, layers and/or sections, these elements, components, regions, layers and/or sections should not be limited by these terms. These terms can be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Unless otherwise stated in this disclosure, the phrase "permanently coupled" may be interpreted to mean inseparable without damaging one or more of the coupled components. For example, two components may be permanently coupled by having a detent of one component received within an aperture of the other component, where decoupling of the two components would necessitate shearing or fracturing all or a portion of the detent received within the aperture.

As shown in FIGS. 1-11, a utility sink system 100, a kit 200 for the utility sink system 100, and a method 300 of assembling the utility sink system 100 are disclosed herein. The utility sink system 100 can include a basin 102, a plurality of legs 104, and a shelf 106. Each one of the legs 104 can be coupled to both the basin 102 and the shelf 106, as discussed in greater detail herein. In certain embodiments, each of the basin 102, the plurality of legs 104, and the shelf 106 can each be a unitary structure formed by injection molding. A skilled artisan can form the components of the utility sink system 100 by any other suitable manufacturing process, as desired.

The basin 102 can include a base wall 108 and at least one side wall 110. The base wall 108 can include a drain formed therethrough. In certain embodiments, the drain can be configured to be in communication with a plumbing system (not shown) and can be configured to allow liquid or other debris to pass from the basin 102, through the drain, and into the plumbing system.

Figure 2:
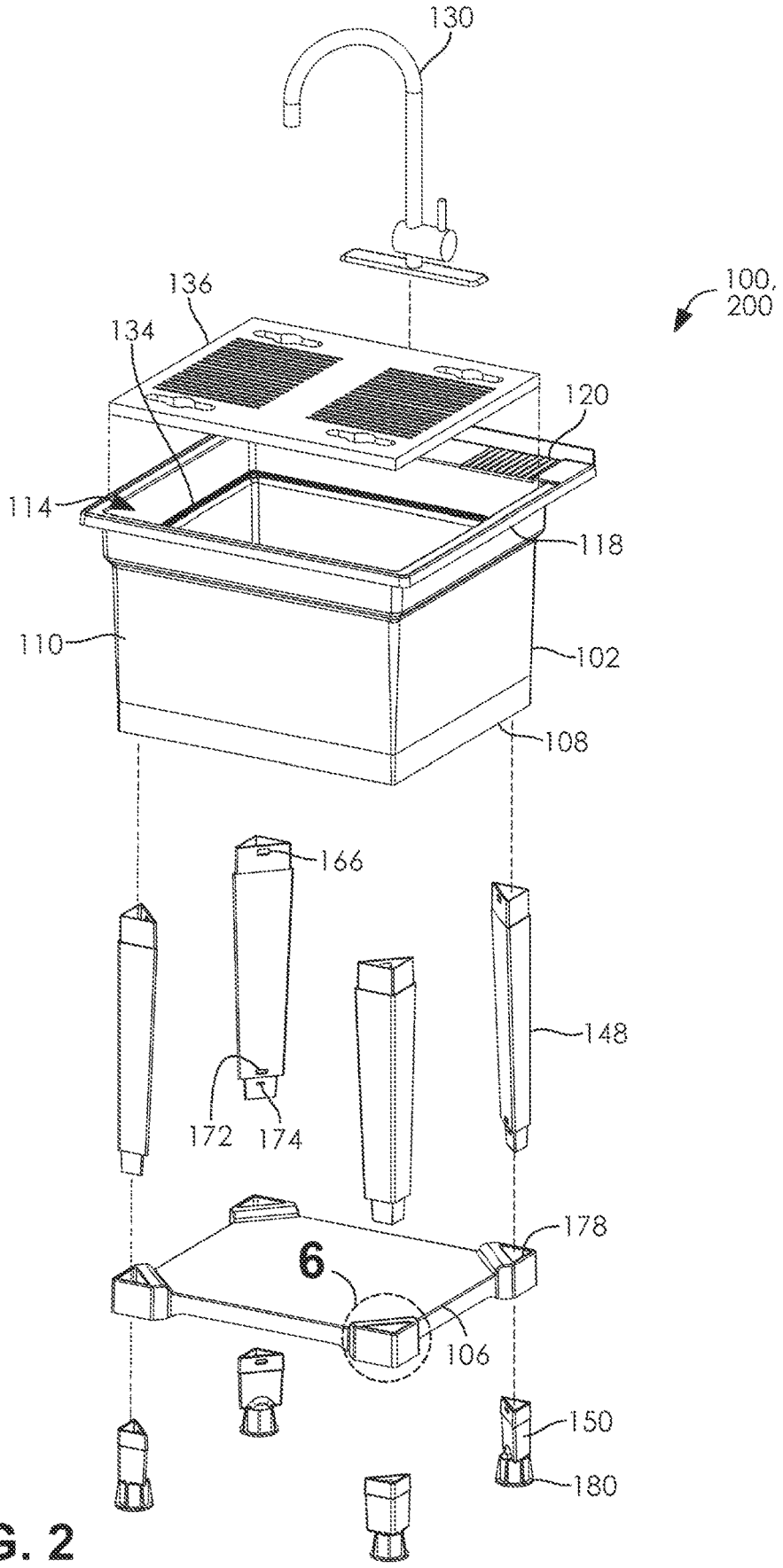
FIG. 2 is an exploded front perspective view of a kit for the utility sink system shown in FIG. 1.
Figure 3:
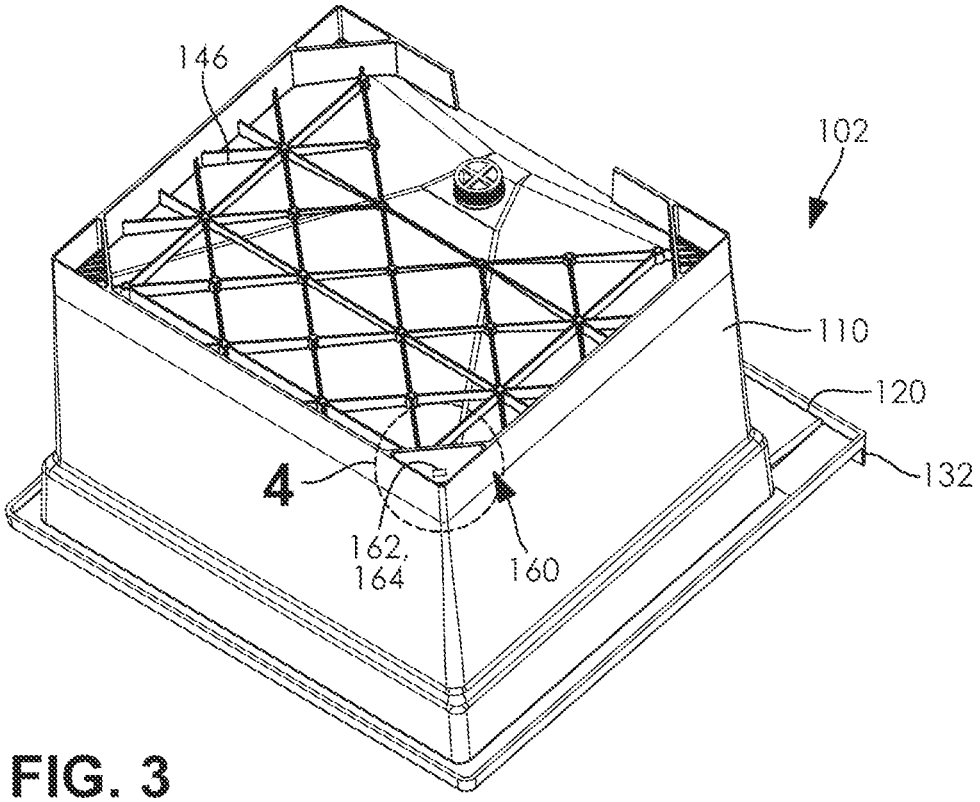
FIG. 3 is a bottom perspective view of a basin of the utility sink system of FIG. 1.

As shown in FIGS. 1-3, the basin 102 can include four side walls 110 where each side wall 110 extends substantially perpendicular to the base wall 108 and is connected to other side walls 110. Each of the side walls 110 can have an interior surface, which can form a major continuous interior surface 114 of the basin 102. Though depicted as substantially planar herein, it should be appreciated that the interior surface 114, formed by each of the side walls 110, can be tapered or otherwise angled inward towards the drain, which can direct liquid more efficiently to the drain, in operation. Likewise, the base wall 108 can angle downward to the drain. A skilled artisan can select other suitable angles and tapers for each of the side walls 110 and the base wall 108. An upper edge of each of the side walls 110 can form a continuous upper edge 116 of the basin 102. The upper edge 116 of the basin can be circumscribed by a lip 118. Advantageously, the lip 118 can provide a contoured surface, which can improve the comfort of the user, in operation.

The lip 118 can include a rack 120 extending therefrom. The rack 120 can be permanently coupled to the basin 102. The rack 120 can include a drying means 122. In a specific example, the drying means 122 can include one or more recessed surfaces 124 and one or more fins 126 extending from the one or more recessed surfaces 124. The recessed surface 124 can be oriented substantially transverse to the sidewall 110 of the basin 102. The fin 126 can be configured to support an object, such as a bar of soap (not shown) while allowing any liquid to drain onto the recessed surface 124. The recessed surface 124 can be downward toward the basin 102 to direct the liquid into the basin 102. The rack 120 can further include a plumbing coupling 128. The plumbing coupling can be configured to accept a faucet assembly 130 and/or a hose therethrough.

The rack 120 can further include a rear wall 132 that can be oriented substantially transverse to the rack 120. In certain embodiments, the rear wall 132 can be oriented substantially perpendicular to the rack 120. The rear wall 132 can extend upwardly from the rack 120. Advantageously, the upwardly extending rear wall 132 can be configured to provide a splash rack feature. In certain embodiments, the rear wall 132 can also extend downwardly from the rack 120. Desirably, the downwardly extending rear wall 132 can permit the utility sink system 100 to be coupled to a wall, as desired.

As shown in FIG. 2, the basin 102 can further include a ledge 134 formed on the interior surface 114 of the basin 102. The ledge 134 can be disposed above the base wall 108 and below the lip 118 of the basin 102. The ledge 134 can be configured to support a tray 136 above the base wall 108 of the basin 102.

Figure 5:
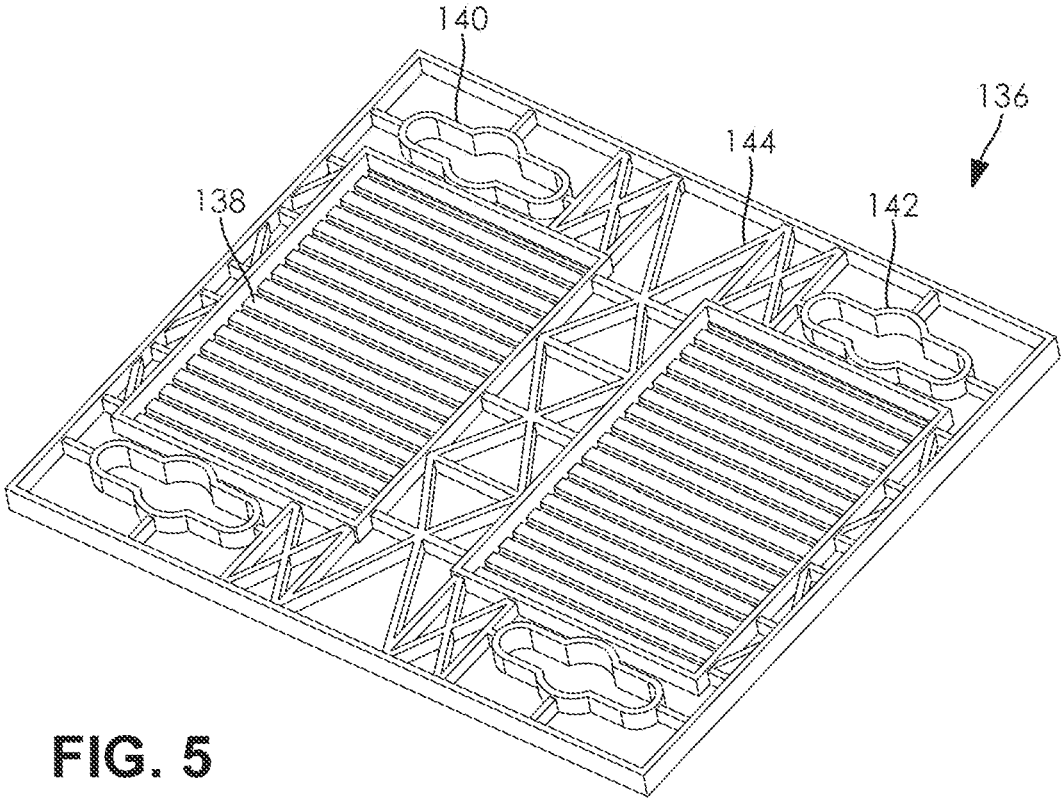
FIG. 5 is a bottom perspective view of a tray of the utility sink system of FIG. 1.

As shown in FIGS. 1-2 and 5, the tray 136 can include an array of slats and corresponding apertures 138. The tray 136 can be configured to support an item (not shown) disposed on the tray 136 while permitting liquid (not shown) to pass through the array of slats and apertures 138. The tray 136 can include a handle 140. The handle 140 can be an opening disposed through the tray 136. The handle 140 can be an elongated opening configured to permit a user to grasp the tray 136 through the opening. The handle 140 can further include a cylindrically shaped opening 142 configured to permit a hose or a faucet head (not shown) to be disposed therethrough. A skilled artisan can select other suitable shapes for the handle 140, as desired. As shown in FIG. 5, the tray 118 may include a plurality of support structures 144. The support structures 144 can be disposed in an X-formation, a V-formation, or combinations thereof. Advantageously, the orientation of the support structures 144 can enhance the structural integrity of the tray 144. Similarly, though not shown, an underside of the shelf 106 can also include the support structures 144. One skilled in the art may select any suitable orientation of the support structures 144, within the scope of the present disclosure.

In certain embodiments, as shown in FIG. 3, the base wall 108 of the basin 102 can have a plurality of braces 146 formed in a bottom surface thereof. The braces 146 can be disposed in an X-formation, a V-formation, or combinations thereof. Advantageously, the orientation of the braces 146 can enhance the structural integrity of the basin 102. One skilled in the art may select any orientation of the braces 146, within the scope of the present disclosure.

With reference to FIGS. 2 and 7-10, each of one the legs 104 can include an upper leg portion 148 and a lower leg portion 150. The upper leg portion 148 can include a first end 152 and a second end 154. The lower leg portion 150 can include a third end 156 and a fourth end 158. The first end 152 and the second end 154 of the upper leg portion 148 each have a width that is less than a width of a remainder of the first leg portion 148.

Figure 4:
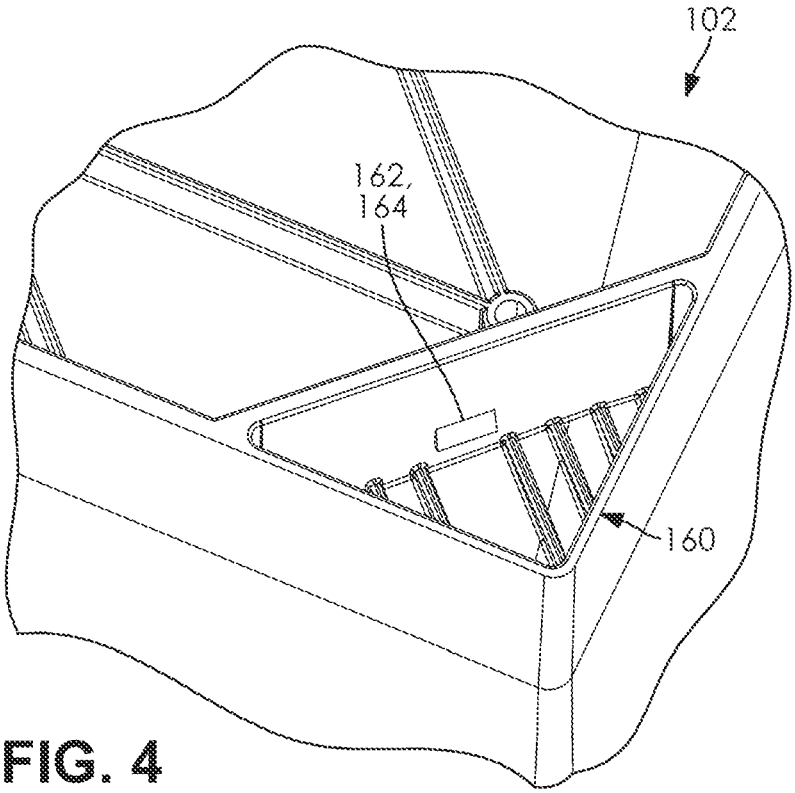
FIG. 4 is an enlarged bottom perspective view of the basin taken at callout 4 in FIG. 3, further depicting a basin detent.

The first end of the upper leg portion 148 can be disposed in the basin 102. In certain embodiments, the upper leg portion 148 can be integrally formed with the basin 102. In other embodiments, as shown in FIG. 1-2, the upper leg portion 148 can be manufactured separately from the basin 102 and then permanently coupled to the basin 102. Each corner 160 of the bottom surface of the base wall 108 of the basin can include a connection means 162, which receives the first end 152 of the upper leg portion 148. In a specific example, the connection means 162 of the basin 102 can include a basin detent 164, as shown in FIG. 4. The basin detent 164 can be disposed into an aperture 166 in the first end the upper leg portion 148. The basin detent 164 and the aperture 166 of the first end 152 of the upper leg portion 148 can cooperate via a snap fit to permanently couple the upper leg portion 150 to the basin 102. A skilled artisan can utilize other means and methods for permanently coupling the basin 102 to the upper leg portion 148, as desired.

Each of the second end 154 of the upper leg portion 148 and the third end 156 of the lower leg portion 150 can be disposed in the shelf 106. In particular, as shown in FIGS. 6-10, each corner of the shelf 106 can have an opening 168 formed therethrough. Each of the second end 154 of the upper leg portion 148 and the third end 156 of the lower leg portion 150 can be disposed in one of the openings 168 of the shelf 106, which can allow the shelf 106 to encapsulate each of the second end 154 of the upper leg portion 148 and the third end 156 of the lower leg portion 150. Advantageously, by encapsulating a portion of the upper leg portion 148 and lower leg portion 150 with the shelf 106, the structural integrity and the strength of the utility sink system 100 may be enhanced.

Figure 6:
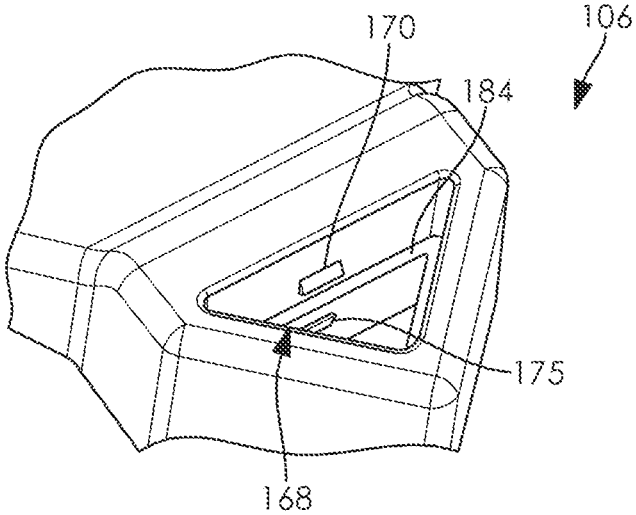
FIG. 6 is an enlarged front perspective view of a shelf taken at callout 6 in FIG. 2, further depicting a shelf detent.
Figure 7:
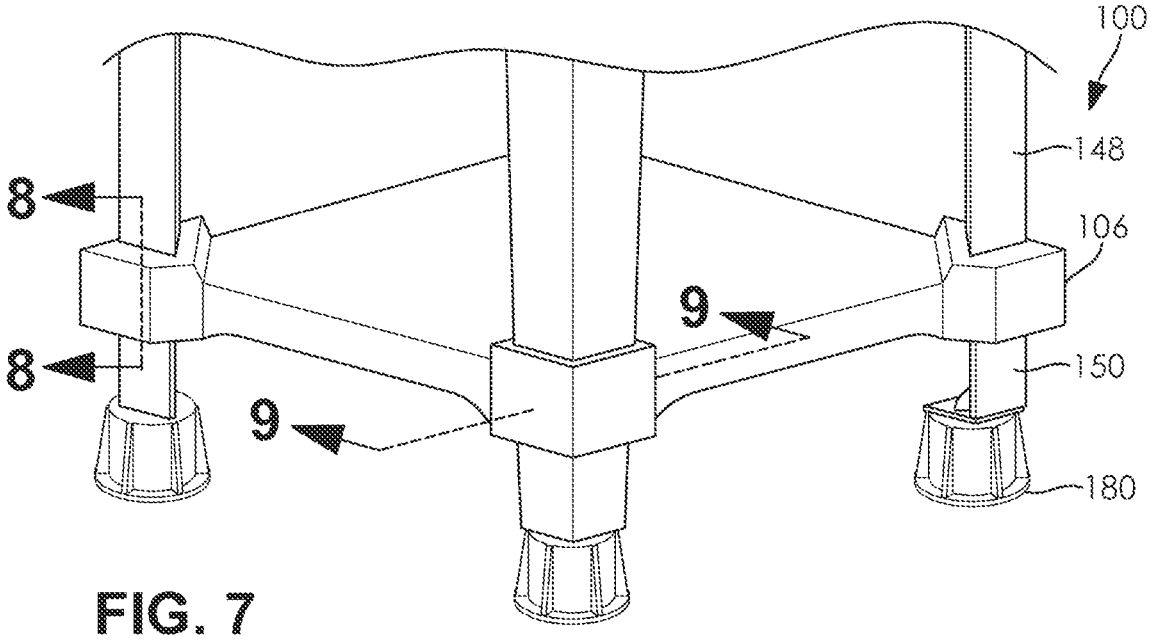
FIG. 7 is an enlarged front perspective view of the utility sink system of FIG. 1, further depicting the shelf encapsulating an upper leg portion and a lower leg portion.
Figure 8:
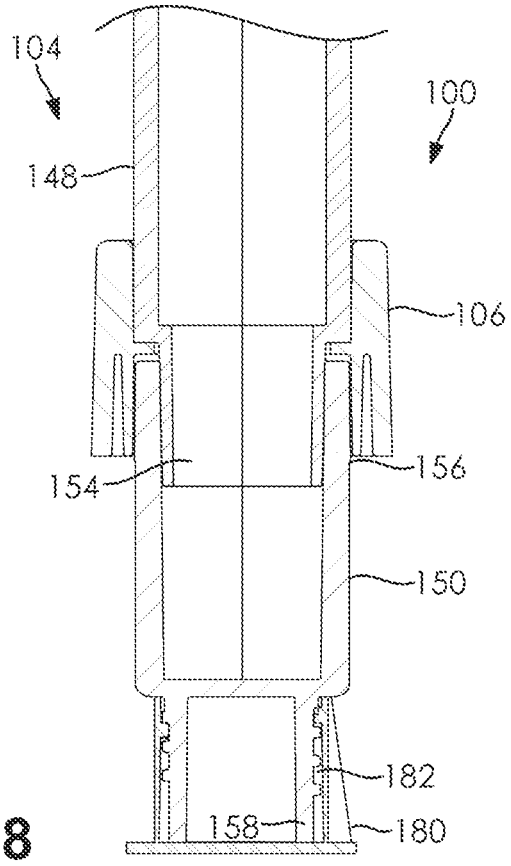
FIG. 8 is an enlarged cross-sectional view taken at section line 8-8 of FIG. 7, further depicting the shelf encapsulating the upper leg portion and the lower leg portion.

With reference to FIG. 6, the opening 168 of the shelf 106 can include an interior rim 184 formed on an interior surface of the opening 168. The interior rim 184 can be abutted on a top side by the second end 154 of the upper leg portion 148 and abutted on a bottom side by the third end 156 of the lower leg portion 150.

Figure 9:
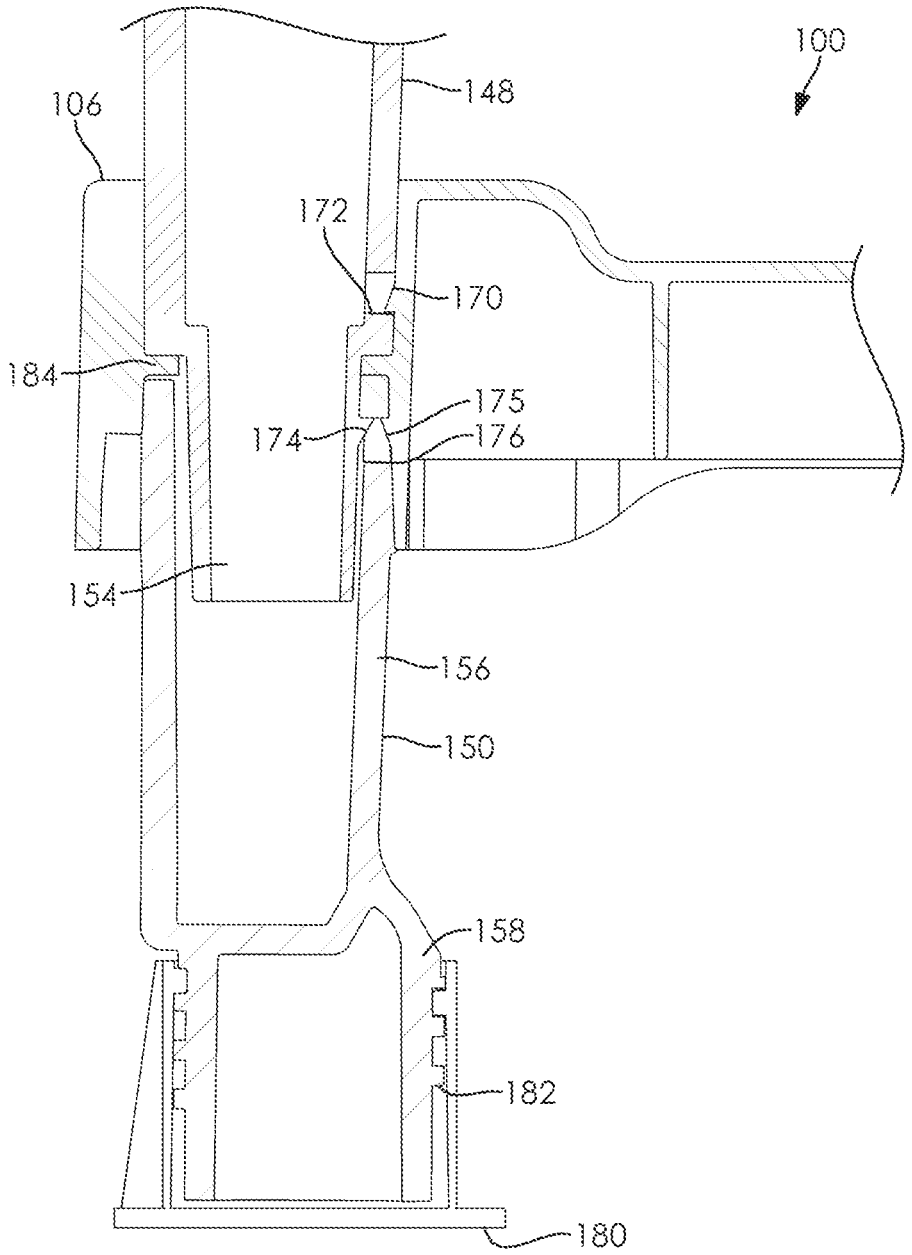
FIG. 9 is an enlarged cross-sectional view taken at section line 9-9 of FIG. 7, further depicting the shelf encapsulating the upper leg portion and the lower leg portion.
Figure 10:
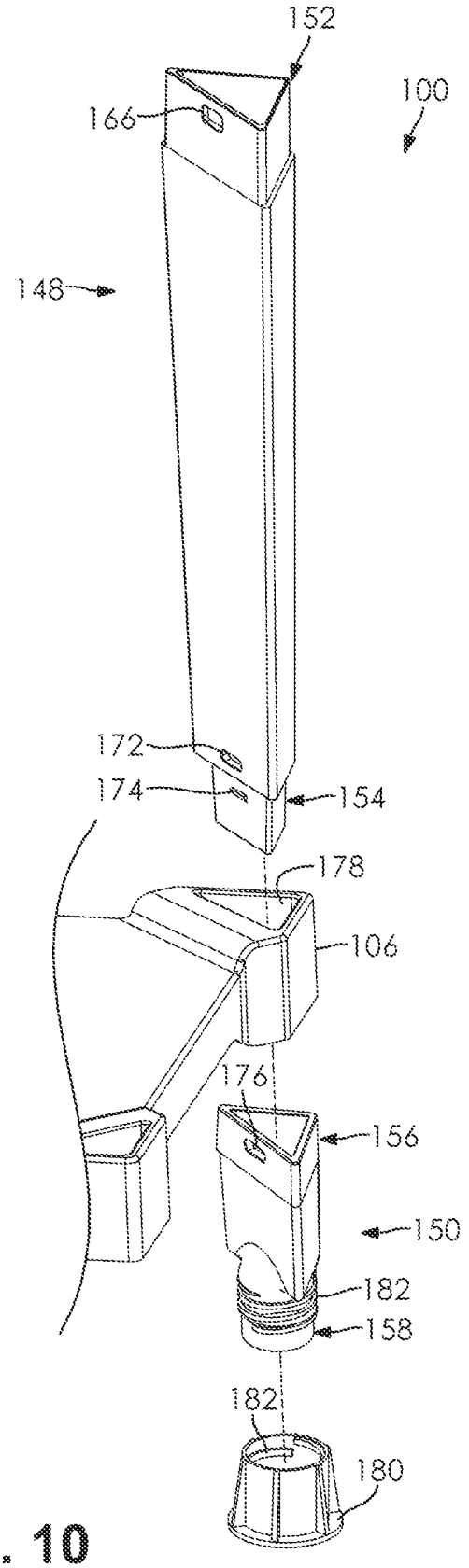
FIG. 10 is an exploded front perspective view of the leg and the shelf of the utility sink system of FIG. 1.

In particular, with reference to FIGS. 9-10, each opening 168 of the shelf 106 can have an upper shelf detent 170 formed therein. In particular, the upper shelf detent 170 can be formed above the interior rim 184 of the opening 168. The upper shelf detent 170 can be disposed in a second end aperture 172 of the second end 154 of the upper leg portion 148. The second end 154 of the upper leg portion 148 can further include a second end detent 174 and the shelf can include a lower shelf detent 175. In particular, the lower shelf detent 175 can be formed below the interior rim 184 of the opening 168. The second end detent 174 and the lower shelf detent 175 can be disposed in a third end aperture 176 of the third end 156 of the lower leg portion 150 where the second end 154 is inserted into an opening 178 of the third end 156. The detents 174, 175 and the third end aperture 176 can cooperate via a snap fit to permanently couple the upper leg portion 148 and the lower leg portion 150 to the shelf 106. A skilled artisan can utilize other means and methods for permanently coupling the legs 104 to the shelf 106, as desired.

It should be appreciated that the upper shelf detent 170 and the second end detent 174 can be oriented in opposite directions, for example, as shown in FIG. 9. The upper shelf detent 170 can be biased at a downward angle and the second end detent 174 can be biased at a downward angle. The opposing biases of the upper shelf detent 170 and the second end detent 174 can provide structural integrity to the utility sink system as the sink could not be disassembled without breaking one of the upper shelf detent 170 and the second end detent 174 due to the opposing snap fits of the components.

The utility sink system 100 can include a foot 180 removably coupled to each one of the legs 104. In particular, each one of the feet 180 can be disposed on the fourth end 158 of the lower leg portion 150. Each one of the feet 180 and the fourth end 158 can include complementary threaded portions 182, which are configured to removably couple the foot 180 to the fourth end 158. The complementary threaded portions 182 can also provide a means to adjust the positioning of the utility sink system 100, when necessary, for instance, where the utility sink system 100 is placed on an uneven or unlevel surface.

Each foot 180 can include one or more ridges extending along a vertical length of the foot. The ridges can militate against the foot 180 from slipping within a hand of a user, where the user is coupling the foot 180 to the lower leg portion 150. The ridges can further reinforce the foot 180 with respect to a weight of a remainder of the utility sink system 100, including any contents or liquids therein. The foot 180 can further include a means of anchoring the utility sink system to a surface. In a specific example, the means of anchoring the utility sink system may include an aperture in the foot 180. The aperture in the foot 180 can be configured to permit a user to bolt, stake, or otherwise couple the utility sink system to the surface.

The present disclosure further contemplates the kit 200 for the utility sink system 100, for example, as shown in FIG. 2. The kit 200 can include the basin 102, the leg 104, the shelf 106, and the tray 136 as described in greater detail hereinabove. The kit 200 can further include the foot 180. In further embodiments, the leg 104 can be provided as the upper leg portion 148 and the lower leg portion 150. It should be appreciated that kit 200 can include the components of the utility sink system 100 as discrete pieces. Various embodiments include where all pieces of the kit 200 are disassembled and various embodiments include where portions of the kit 200 are partially assembled. Advantageously, the kit 200 can be more compactly packed for shipping compared to the assembled utility sink system.

Figure 11:
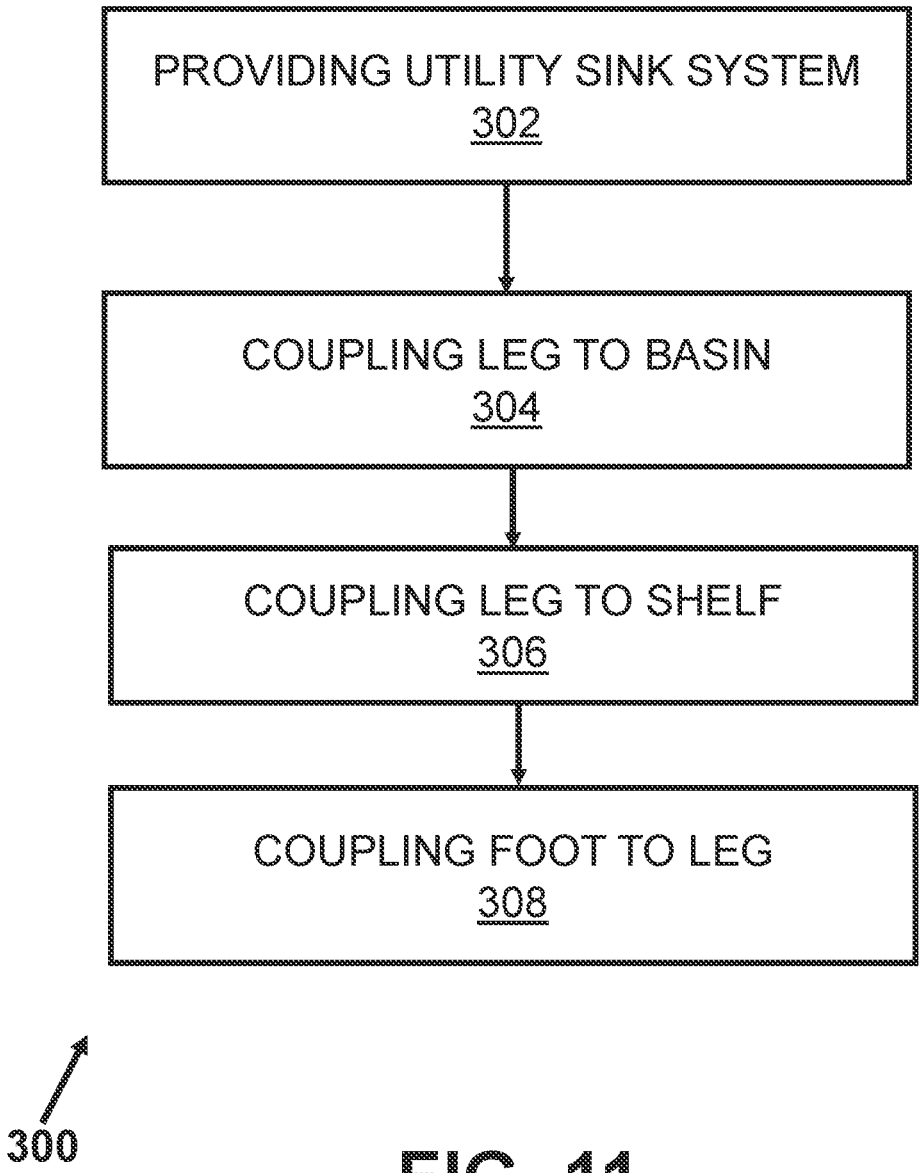
FIG. 11 is a flow chart depicting a method of assembling the kit for the utility sink system, according to a further embodiment of the present disclosure.

The present disclosure further contemplates the method 300 for assembling the utility sink system 100, for example, as shown in FIG. 11. The method 300 can include a step 302 of providing the kit 200 as described hereinabove. The kit 200 can include the basin 102, the leg 104, the shelf 106, and the tray 136 as described in greater detail hereinabove. The kit 200 can further include the foot 180. In further embodiments, the leg 104 can be provided as the upper leg portion 148 and the lower leg portion 150.

The method 300 can include providing a step 304 of permanently coupling the leg 104 to the basin 102. In particular, the upper leg portion 148 can be coupled to the basin 102. The first end 152 of the upper leg portion 148 can be inserted into the corner 160 of the basin 102. The basin detent 164 can be inserted into the aperture 166 on the first end 152 of the upper leg portion 148 thereby permanently coupling the upper leg portion 148 to the basin 102.

The method 300 can include a step 304 of permanently coupling the leg 104 to the shelf 106. In particular, the upper leg portion 148 of the leg 104 can be permanently coupled to the shelf 106 and the lower leg portion 150 of the leg 104 can be permanently coupling to the shelf 106.

The second end 154 of the upper leg portion 148 can be inserted into one of the openings 168 of the shelf 106. The upper shelf detent 170 can be disposed in the second end aperture 172 thereby permanently coupling the upper leg portion 148 to the shelf 106. The third end 156 of the lower leg portion 150 can be inserted into one of the openings 168 of the shelf 106. The third end aperture 176 can receive the lower shelf detent 175 thereby permanently coupling the lower leg portion 150 to the shelf 106. It should be appreciated that the third end aperture 176 can also receive the second end detent 174 thereby permanently coupling the lower leg portion 150 to the upper leg portion 148.

The method 300 can include a step 306 of coupling the foot 180 to the leg 104. In particular, the foot 180 can be disposed on the fourth end 158 of the lower leg portion 150. The threaded portions 182 of the fourth end 158 and the foot 180 can cooperate to removably couple the foot 180 to the leg 104.

Advantageously, the utility sink system provides additional storage options, can be easily transported to a user, and is structurally enhanced.

While certain representative embodiments and details have been shown for purposes of illustrating the invention, it will be apparent to those skilled in the art that various changes can be made without departing from the scope of the disclosure, which is further described in the following appended claims.

What is claimed is:

1. A utility sink system, comprising:

a basin having a base wall and a sidewall extending perpendicularly therefrom;

a leg configured to be permanently coupled to the basin, the leg including and upper leg portion having a first end and a second end and a lower leg portion having a third end and a fourth end, the second end of the upper leg portion configured to be disposed in the third end of the lower leg portion, the first end of the upper leg portion includes an aperture, and a corner of the base wall includes a basin detent, and the basin detent is configured to be disposed in the aperture when the leg is permanently coupled to the basin; and a shelf configured to be permanently coupled to the leg, the shelf configured to encapsulate a portion of the leg, the shelf including an opening with an upper shelf detent formed therein, the second end of the upper leg portion includes a second end aperture, and the upper shelf detent is configured to be disposed in the second end aperture when the shelf encapsulates the portion of the leg.

2. The utility sink system of claim 1, wherein the second end of the upper leg portion includes a second end detent, the third end of the lower leg portion includes a third end aperture formed therein, and the second end detent is configured to be disposed in the third end aperture when the second end of the upper leg portion is disposed in the third end of the lower leg portion.

3. The utility sink system of claim 2, wherein the opening of the shelf further includes a lower shelf detent formed therein, the lower shelf detent configured to be disposed in the third end aperture when the shelf encapsulates the portion of the leg.

4. The utility sink system of claim 3, wherein the opening of the shelf includes an interior rim formed on an interior surface thereof, the interior rim configured to be abutted by the upper leg portion and the lower leg portion.

5. The utility sink system of claim 4, wherein the upper shelf detent is disposed in the opening above the interior rim and the lower shelf detent is disposed in the opening below the interior rim.

6. The utility sink system of claim 2, wherein the upper shelf detent and the second end detent are biased in opposite directions.

7. The utility sink system of claim 1, wherein a ledge is formed on an interior surface of the basin and spaced apart from the base wall.

8. The utility sink system of claim 7, further including a tray configured to be removably disposed on the ledge.

9. The utility sink system of claim 8, wherein the tray includes a plurality of support structures on a bottom surface thereof.

10. The utility sink system of claim 8, wherein the tray includes a handle in the form of an elongated opening formed through the tray.

11. The utility sink system of claim 8, wherein the tray includes an array of slats and apertures formed therein, the apertures passing through the tray.

12. The utility sink system of claim 1, further including a foot configured to be removably disposed on the leg.

13. The utility sink system of claim 12, wherein each of the foot and the leg includes a threaded portion, the threaded portions configured to cooperate to removably secure the foot to the leg.

14. The utility sink system of claim 1, wherein the upper leg portion is integrally formed with the basin.

15. The utility sink system of claim 1, wherein each of the first end and the second end of the upper leg portion have a width that is smaller than a width of the remaining portion of the upper leg portion.

16. The utility sink system of claim 1, wherein the leg is disposed in the basin and the leg is disposed in the shelf.

17. A method of assembling a utility sink system, the method comprising the steps of:

providing a basin having a base wall and a sidewall extending perpendicularly therefrom, a leg configured to be permanently coupled to the basin, the leg including and upper leg portion having a first end and a second end and a lower leg portion having a third end and a fourth end, the second end of the upper leg portion configured to be disposed in the third end of the lower leg portion, the first end of the upper leg portion includes an aperture, and a corner of the base wall includes a basin detent, and the basin detent is configured to be disposed in the aperture when the leg is permanently coupled to the basin, a shelf configured to be permanently coupled to the leg, the shelf including an opening with an upper shelf detent formed therein, the second end of the upper leg portion includes a second end aperture, and the upper shelf detent is configured to be disposed in the second end aperture when the shelf encapsulates the portion of the leg; and performing one of:

coupling the leg to the basin; and coupling the shelf to the leg.

* * * * *